US008646546B2

(12) United States Patent
Biserna

(10) Patent No.: US 8,646,546 B2
(45) Date of Patent: Feb. 11, 2014

(54) SYSTEM FOR HANDLING EQUIPMENTS FOR THE DRILLING OF THE GROUND

(75) Inventor: Ezio Biserna, Longiano (IT)

(73) Assignee: Soilmec S.p.A., Cesena (FC) (IT)

( * ) Notice: Subject to any disclaimer, the term of this patent is extended or adjusted under 35 U.S.C. 154(b) by 270 days.

(21) Appl. No.: 12/976,751

(22) Filed: Dec. 22, 2010

(65) Prior Publication Data

US 2011/0174511 A1 Jul. 21, 2011

(30) Foreign Application Priority Data

Dec. 22, 2009 (IT) ..... TO2009A1021

(51) Int. Cl.
*B23Q 5/12* (2006.01)

(52) U.S. Cl.
USPC ..... 173/147; 173/148; 173/184

(58) Field of Classification Search
USPC ..... 173/11, 31, 81, 147, 148, 184; 175/57, 175/207, 323
See application file for complete search history.

(56) References Cited

U.S. PATENT DOCUMENTS

| | | | | |
|---|---|---|---|---|
| 3,869,003 | A * | 3/1975 | Yamada et al. | 175/171 |
| 5,269,107 | A * | 12/1993 | Klemm | 52/115 |
| 5,544,978 | A * | 8/1996 | Albers | 405/232 |
| 5,630,477 | A * | 5/1997 | Minatre | 173/184 |
| 5,733,068 | A * | 3/1998 | Reinert, Sr. | 405/232 |
| 5,746,277 | A * | 5/1998 | Howell, Jr. | 173/184 |
| 6,725,946 | B2 * | 4/2004 | Howell, Jr. | 173/184 |
| 7,559,377 | B2 | 7/2009 | Stoetzer | |
| 7,775,300 | B2 | 8/2010 | Krollmann | |
| 2009/0139731 | A1 | 6/2009 | Rieder et al. | |

FOREIGN PATENT DOCUMENTS

| | | |
|---|---|---|
| DE | 41 32 314 | 12/1992 |
| DE | 101 13 561 | 9/2002 |
| EP | 1 672 165 | 6/2006 |
| EP | 1 978 204 | 10/2008 |
| EP | 2 093 373 | 8/2009 |
| GB | 2 106 953 | 4/1983 |

* cited by examiner

*Primary Examiner* — Alexandra Elve
*Assistant Examiner* — Nathaniel Chukwurah
(74) *Attorney, Agent, or Firm* — Merchant & Gould P.C.

(57) ABSTRACT

A handling system (1") is for drilling equipment (200) of the ground, in which the drilling equipment (200) slides along a support tower (101, 501) fixed or movable with respect to the ground. The handling system (1") includes at least one linear actuator (3, 3*a*, 3*b*) for handling the digging equipment. The linear actuator (3, 3*a*, 3*b*) being temporarily movable and releasable with respect to the tower (101, 501).

15 Claims, 11 Drawing Sheets

SYSTEM FOR HANDLING EQUIPMENTS FOR THE DRILLING OF THE GROUND

This application is claims benefit of Serial No. TO2009A001021, filed 22 Dec. 2009 in Italy and which application is incorporated herein by reference. To the extent appropriate, a claim of priority is made to the above disclosed application.

BACKGROUND

The present invention relates to the field of drilling technologies, and to a system for handling equipments for the drilling of the ground.

It is known that the procedures for realizing a digging of the foundation, for consolidation or for drainage of the ground refer with an absolute priority to a tower machine comprising a power assembly and means for drilling and means for digging the ground; said tower being delimited in its upper part by a head and in its lower part by a foot and the power assembly (hydraulic or electric) moves along the over-said tower between the head and the foot, by transmitting the rotary motion and an advancement or lift force to the digging means.

During the course of time, the increasing of power in internal combustion engines and in electric engines have promoted the increase of the drilling diameters, with the need of providing handling systems whose sizes and hardness could be well proportioned, in terms of performances, to the new realizable digging diameters.

The handling system to which can be referred in order to guarantee a constant pushing on the digging tool and/or to remove the battery when the digging is finished, are practically of two kinds:

handling systems with flexible elements: a rope winch or chain motor-reducer;

rigid handling systems: for example actuated by means of an hydraulic cylinder.

The handling systems with flexible elements, and more precisely the feeling systems with ropes consist in the application on the machine of one or more winches comprising a drum around which a rope is wound. The tractions can be "multiplied" with returns where the introduction/extraction force is increased, to the detriment of handling speed of the digging means: the greater the handling force, the lower the force which can be applied over them. To each doubling of a traction corresponds half sliding speed of the power assembly along the tower.

In drilling machines of the last generation, a nominal extraction force of the digging means, at 100 t is very common. To obtain such a force, with a winch with a traction capability of 25 t, it is necessary to provide a return in the fourth grade. If the speed of the rope is 80 m/min with a direct traction, this speed will be proportionally reduced at only 20 m/min with a traction of the fourth grade. The multiplied tractions require the mounting of a relevant quantity of pulleys perfectly and mutually aligned, both on the power assembly and its upper end (head) and lower end (foot) of the tower. This fact causes a relevant difficulty in designing the carpentry and a distribution of the weights housed in very high positions, with a consequent arising of the centre of gravity of the machine, damaging its stability and with more difficulties in lifting the tower in case of self-lifting tools. The presence of a plurality of pulleys causes a loss of efficiency and the actual traction becomes greatly lower than the nominal one.

Despite the complexity and the cost of the handling systems with ropes, these permit in general, a more rapid conversion of the machine from one technology to the other (for example passing from a machine configuration for providing drilled poles to a configuration for providing constipated poles) with respect to the handling systems of the rigid type, such as the cylinder type.

The handling systems with flexible elements, provided with a motor-reducer and a chain are completely equal to the previous ones, but owing to their dimensioning and the required weights, they are installed in few cases in which relevant extraction/pushing forces combined with limited strokes are required. Practically in the smaller-size machines it is possible to obtain more frequently this type of solution instead of the handling system with winches and ropes.

The handling systems of the cylinder type are cheaper and lighter for being applied on the towers and they have very high yields, but they permit limited strokes, normally not higher than 10 m with pushing forces around 30 t. The translation speed of the cylinders depends on the flow and on the diameters, but it can be approx. 10-15 m/min.

Practically, the handling system of the cylinder type, despite its simplicity, provides strokes and extraction speeds lower than the system of the rope type.

Also, the machine conversion needed to pass from one technology to the other requires long transformation times, especially if it is performed in a yard.

EP 1,672,165 illustrates a handling system of a digging assembly operating by means of chains, fixed to a guide tower, on which pinions connected with motor-reducers engage, whose casing is linked to the structure itself of the power assembly. By imposing a rotary motion to the pinion by means of motor-reducers, one can obtain the handling and so pulling and the pushing on the power assembly. The system, despite the fact that it permits to obtain relevant speeds (maximum values around 35 m/min) is limited to traction or pushing forces slightly greater than 10 t, which are not sufficient to satisfy all the digging technologies.

SUMMARY

The aim of the present invention is therefore to describe a handling system for ground drilling tools, which has none of the drawbacks described above and permits to obtain strong tractions, high handling speeds, optimal yields, the possibility to actuate the handling forces in any position of the antenna, by exploiting the whole stroke present and thanks to its simplicity, with reduced times of transformation for the conversion from one technology to the other.

According to the invention, a handling system for ground drilling tools is realized.

BRIEF DESCRIPTION OF THE DRAWINGS

The invention will now be described with reference to the annexed drawings, which illustrate one of its actuating and non limitative examples, wherein.

DETAILED DESCRIPTION

Figure 1:
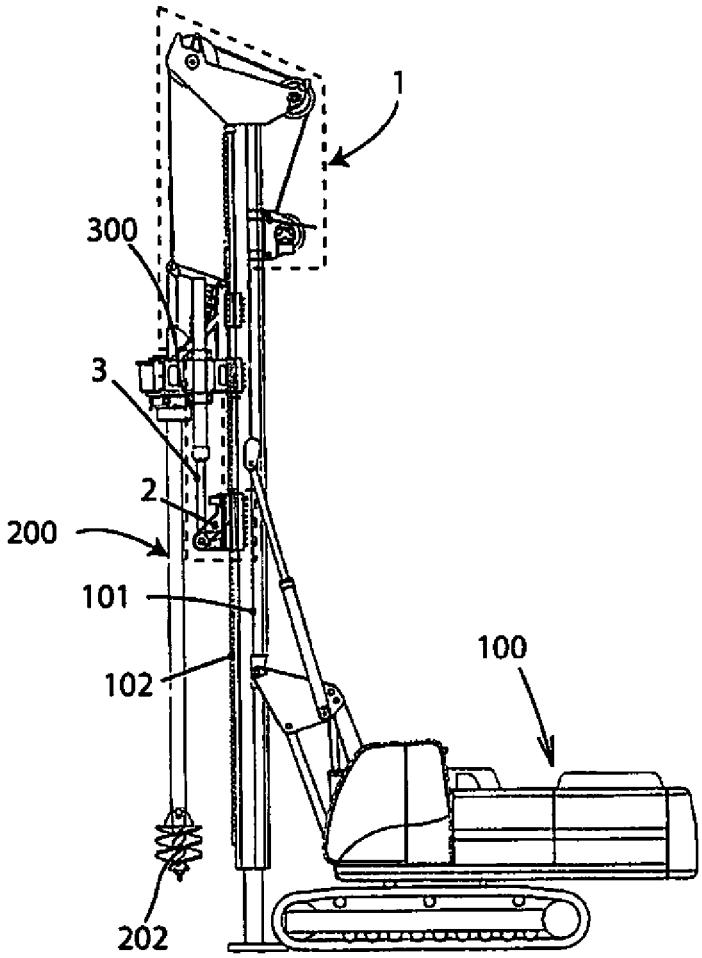
FIG. 1 shows a side view of an operating machine provided with a digging equipment mounted on a tower, which is handled by a first embodiment of a handling system according to the present invention.

With reference to FIG. 1, a handling system of drilling equipments (drill, insertion, vibration) of the ground is indicated with 1 in its entirety.

Handling system 1 is a mixed actuation system and uses both flexible means (ropes) and rigid means (cylinder or an equivalent linear actuator means). Such a system is generally defined as a drilling "traction/pushing" system or with "insertion/extraction" system, and so it works with the combined use of a first handling sub-system with rigid elements and a second handling sub-system with flexible elements.

Handling system 1 is installed on an operating machine 100 handled on tracks and comprises a guide cabin inside which an operator actuates the main systems with which the machine is formed, such as the operation of a digging equipment 200. In detail, digging equipment 200 is installed on a tower 101 of operating machine 100 such to slide linearly between a first end of tower 101 (head) and a second end of tower 101 (foot), and vice versa, in order to penetrate into the ground by drilling a hole and inserting a tool or a foundation element during a descent phase (drilling).

Alternatively, the system that is the object of the present invention can be installed also on a tower mounted fixed with respect to the ground, for example on a trestle.

Digging equipment 200 is operated in rotation by means of a power assembly 300 which also slides integrally with digging equipment 200 along tower 101 and comprises a battery of rods 201 to which a digging tool 202 is fixed (in this particular case, a drill). The battery of rods 201 and digging tool 202 are rotated by power assembly 300.

Similarly, the digging assembly can be considered also of the insertion type (percussion, vibration) and digging equipment 200 in this case is inserted and/or extracted in order to perform digging techniques in which temporary or definitive foundation elements are inserted into the ground.

Again, the digging equipment could be formed by a telescopic rod (Kelly) commonly used in this field.

Handling system 1 comprises an element 2 which is temporarily sliding with respect to said tower 101, and is bound by means of one or more hydraulic cylinders 3 to the upper power assembly 300. Such hydraulic cylinder therefore is completely movable with respect to tower 101, during the phase in which elements 2 are temporarily sliding and power assembly 300 is movable with respect to the tower.

Figure 2:
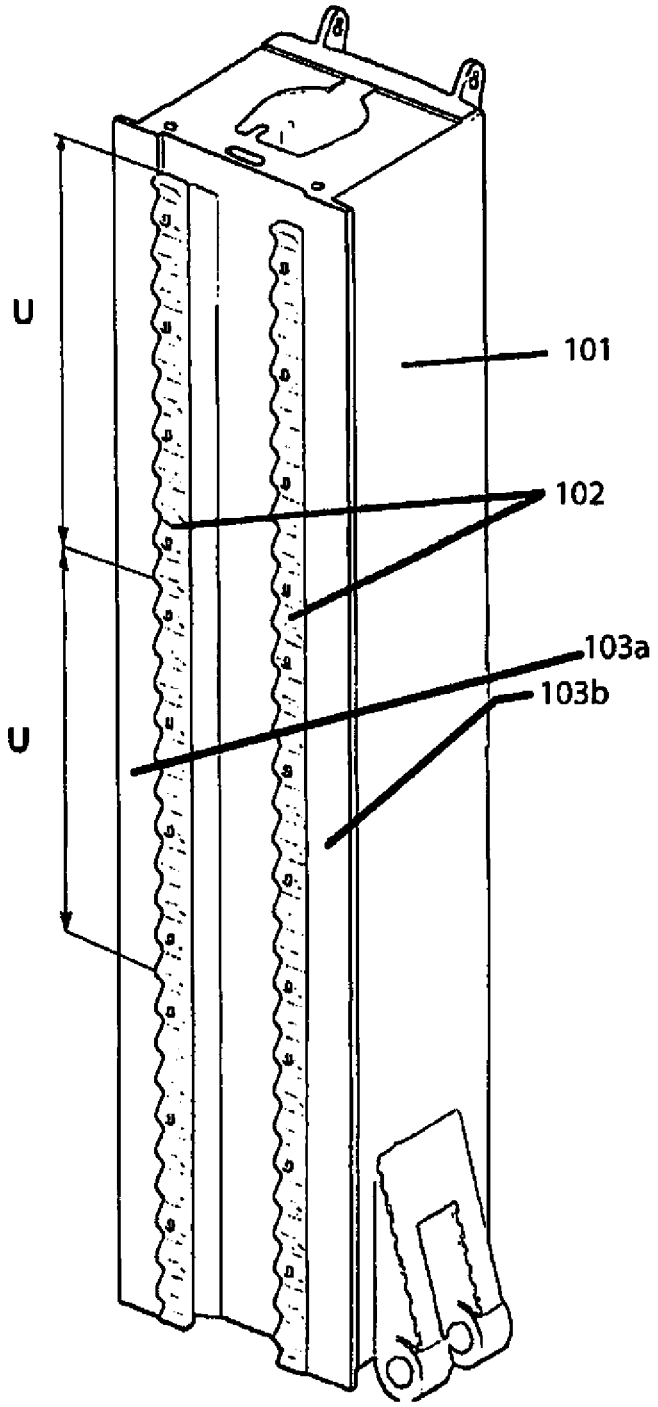
FIG. 2 shows a perspective view of the tower in FIG. 1.

As shown in FIG. 2, tower 101, having a rectangular section, comprises a pair of racks 102 which are preferably fixed in a temporary way (bolted) to tower 101 on subsequent sectors with a constant distance, and a pair of lateral guides 103*a*, 103*b* protruding towards the outside of opposite lateral walls of tower 101 laying on a same plane; tracks 102 are developed parallel to a direction which is substantially parallel to a maximum extension direction of tower 101, in order to permit the sliding of the power assembly along guides 103*a*, 103*b*.

Figure 3:
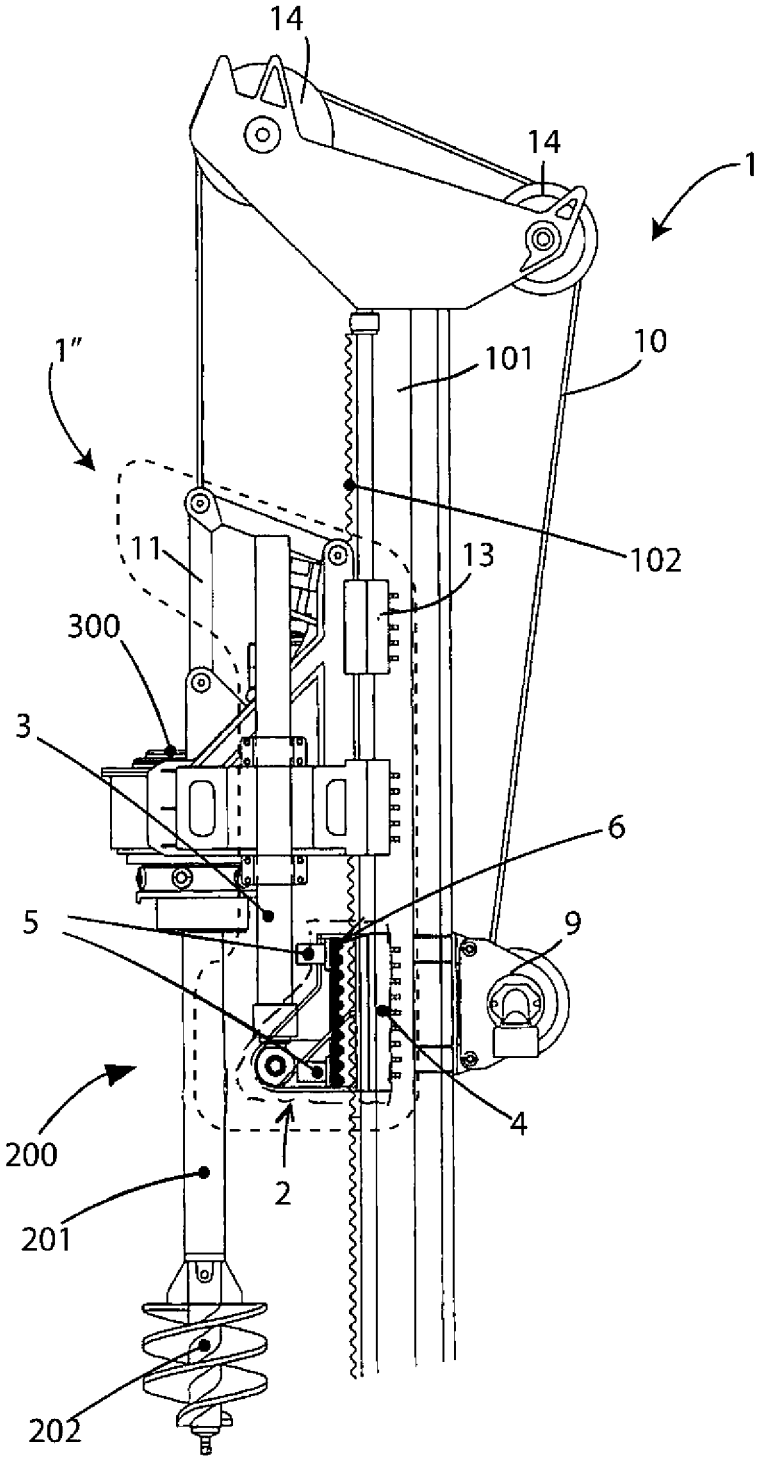
FIG. 3 shows a side view in detail of a portion of the tower in FIG. 1, of the handling system of the invention and of the digging equipment.

As shown in greater detail in FIG. 3, element 2 is provided with a pair of lateral jaws 4 with a return slide and are so designed to slide on guides 103*a*, 103*b* of tower 101 and a pair of blocking jacks 5 with a preferably hydraulic control, but being also realizable with an electric or pneumatic control, which extend in a direction orthogonal to the sliding direction of element 2 on guides 103*a*, 103*b*.

Advantageously, an accumulator is inserted in line with the connection of the blocking actuators (5) in order to accelerate the insertion and disconnection of toothed element 6 on rack 102.

Element 2 is also provided with a toothed element 6 which is moved by blocking jacks 5; in a first position of use, toothed element 6 is far from tracks 102 and does not interfere with them; on the contrary, due to the fact that blocking jacks 5 are extended, such toothed element 6 comes in contact with tracks 102 by blocking the sliding of element 2 with respect to tower 101.

In order to have the highest operating safety toothed element 6 can be kept against tracks 102 by elastic means, which are pressed because blocking jacks 5 are retracted. In this way, without the feeding of the jacks, it is sure that element 2 does not slide freely on tower 101.

When toothed element 6 is pushed against tracks 102 the return slide of jaws 4, by acting against guides 103, contrasts the pushing of said blocking jacks 5.

When toothed element 6 is engaged on tracks 102, element 2 is integrally bound to tower 101 and so by means of cylinder 3 it is possible to exert on digging equipment 200 a traction or pushing force F towards the ground.

Handling system 1 in an embodiment of the invention also comprises a winch 9 on which a rope 10 is wound, having an end (or lug) fixed to a traction element 11 fixed on the aforesaid power assembly 300. Winch 9 shown mounted on tower 101, could be installed also on machine 100.

Rope 10 is in directly traction and slides on a pair of pulleys 14 realizing a fixed pulley, without reduction returns. Such pulleys 14 are mounted on the first end of tower 101, in a position of a maximum height with respect to the ground and they are so placed to lay on the same plane, in order to permit the sliding of rope 10. Similarly, the same structure can be realized with just one pulley, possibly with an actual traction no longer centred on the digging axis, but nearer to guide tower 101.

Figure 4:
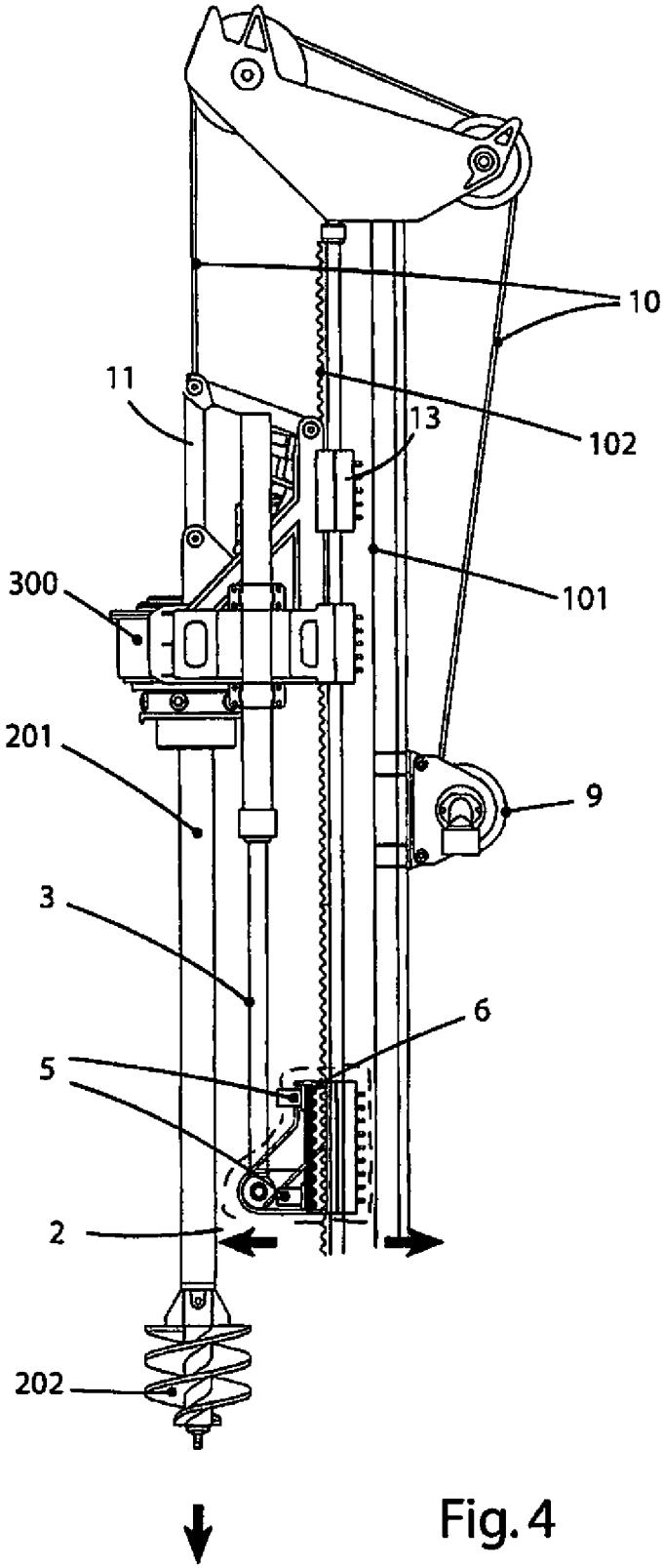
FIG. 4 shows a side view of the handling system as in FIG. 3, in a first pattern of use.

As shown in FIG. 4, which illustrates a first embodiment of use of handling system 1 that is the object of the present invention, in a descent phase a further pushing force is not required with the force of gravity tending to move digging equipment 200 and power assembly 300 from a risen position towards the ground itself. Such force of gravity comprises at least the weight of the digging equipment and that of power assembly 300.

Digging equipment 200 and power assembly 300 are released in this case by winch 9, which slows down the stroke towards the ground.

During the descent towards the ground, hydraulic cylinder 3 connecting power assembly 300 and element 2 are preferably open and completely extended; nevertheless a configuration is possible in which a smaller extension with respect to the full extension is present, without causing in this way operating differences of the handling system. During the descent towards the ground, blocking jacks 5 also retract toothed element 6 from tracks 102.

Figure 5:
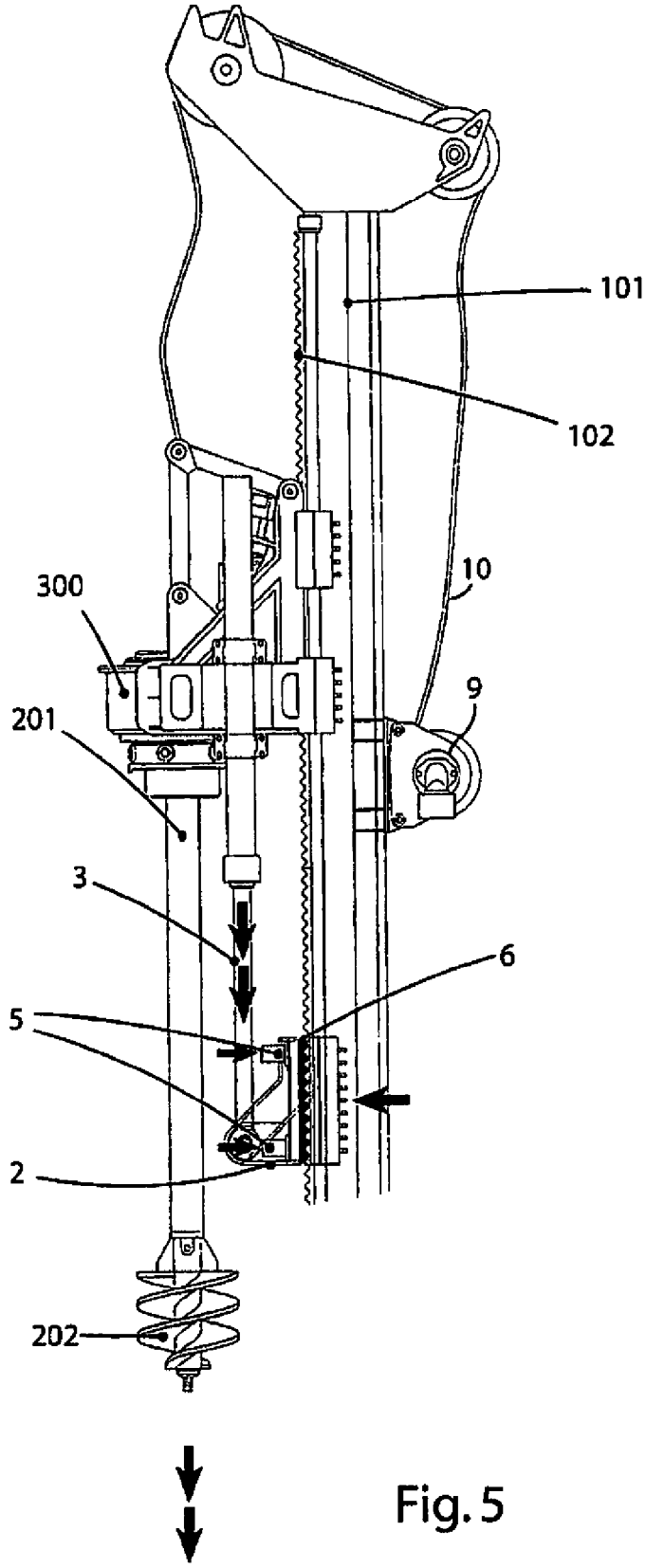
FIG. 5 shows a side view of the handling system as in FIG. 3, in a second pattern of use.

As shown in FIG. 5, when digging tool 202 in order to continue the digging requires a pushing force greater that the previously described force of gravity, it is possible to use element 2. In such second configuration of use, a first operative step advantageously provides that cylinder 3 be extended in order to push element 2 at the maximum distance from power assembly 300.

So a second step provides the extension of blocking jacks 5, in order to bring toothed element 6 against rack 102, so integrally blocking element 2 with the tower.

Then cylinder 3 is actuated in order to permit the approaching of the group formed by power assembly 300 and the digging equipment to element 2, with a compression action against the ground of digging tool 201 (third step). In detail, element 2 having been placed between the ground and power assembly 300, cylinder 3 is returned, substantially by "pulling" power assembly 300 against element 2 towards the ground.

The previous first, second and third steps can be repeated in sequence during the continuation of the digging, in which digging tool 202 penetrates deeper and deeper in the ground.

The position of cylinder 3 can be aligned with the digging axis, in order to make the traction more efficient, so not exerting an eccentric traction on equipment 200. However this causes greater stresses on fixing elements 6, 102 of element 2, which preferably already have a plurality of meshing teeth.

During the second embodiment of use rope 10 is left free to extend (in FIG. 5 the rope is therefore shown released and not tensioned) or winch 9 is brought in an idling position.

Figure 6:
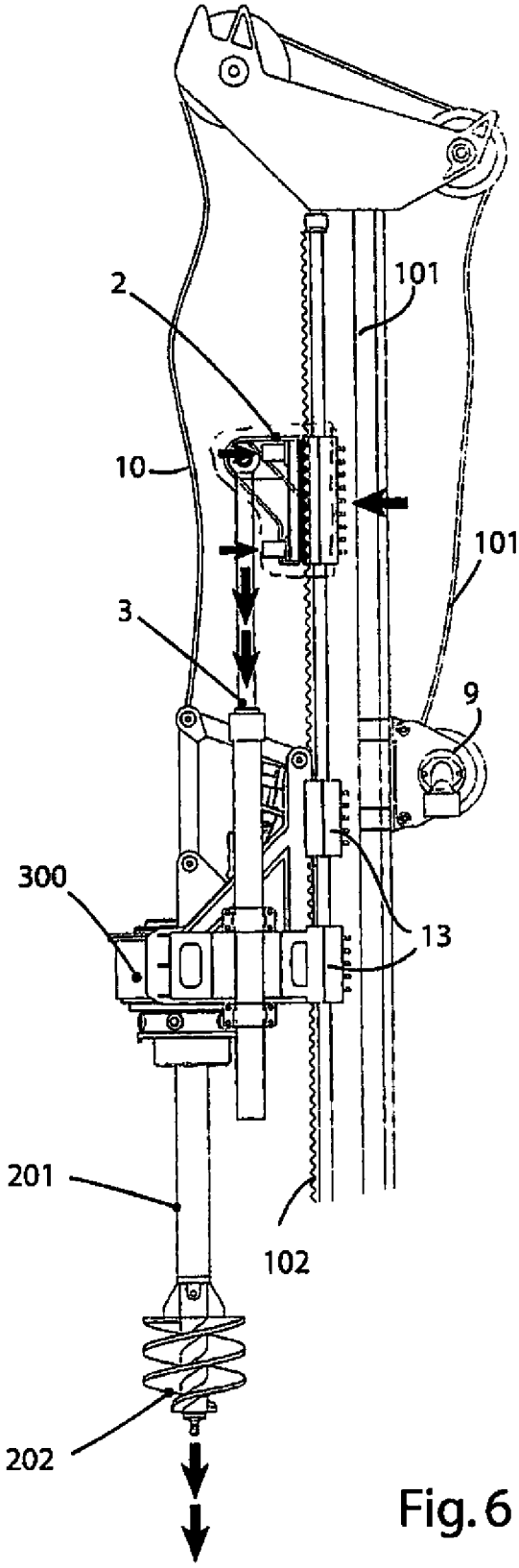
FIG. 6 shows a side view of a detail of the tower in FIG. 1, of the digging equipment in FIG. 1 and of a second embodiment of a handling system according to the present invention.

A second embodiment of the handling system is shown in FIG. 6; in such an embodiment, element 2 is not installed between the ground and power assembly 300, but on the contrary it is installed between power assembly 300 and the first end (head) of tower 101. In use therefore element 2 will always be at a higher level with respect to power assembly 300.

The operation of the second embodiment of the invention here described does not substantially differ from what previously described; only the compression and the extension of cylinder 3 are inverted with respect to what already written. In particular, in the first embodiment of use the operation of the handling system does not change, whereas, concerning the second embodiment of use, handling system 1 operates in the following way.

As shown in FIG. 6, when digging tool 202 in order to continue the digging requires a pushing force greater than the force of gravity previously described, it is then possible to use element 2.

In such a second embodiment of use, a first operating step provides that cylinder 3 be retracted in order to push element 2 at a minimum distance from power assembly 300.

So a second step provides the extension of blocking jacks 5, in order to bring toothed element 6 against rack 102, so integrally blocking element 2 with tower 101.

At this point cylinder 3 is actuated in order to permit the approaching of the group formed by power assembly 300 and digging equipment 200 to element 2, with a compression action against the ground on digging tool 201 (third step). In detail, element 2 being positioned between the top of tower 101 and power assembly 300, cylinder 3 is extended, substantially "pushing away" power assembly 300 from element 2 towards the ground.

The previous first, second and third steps can be repeated in sequence during the continuation of the digging, in which digging tool 202 penetrates deeper and deeper in the ground.

During the second pattern of use, rope 10 is left free to extend (in FIG. 5 the rope is represented, therefore, as released and not tensioned) or winch 9 is brought in an idling position.

Figure 7:
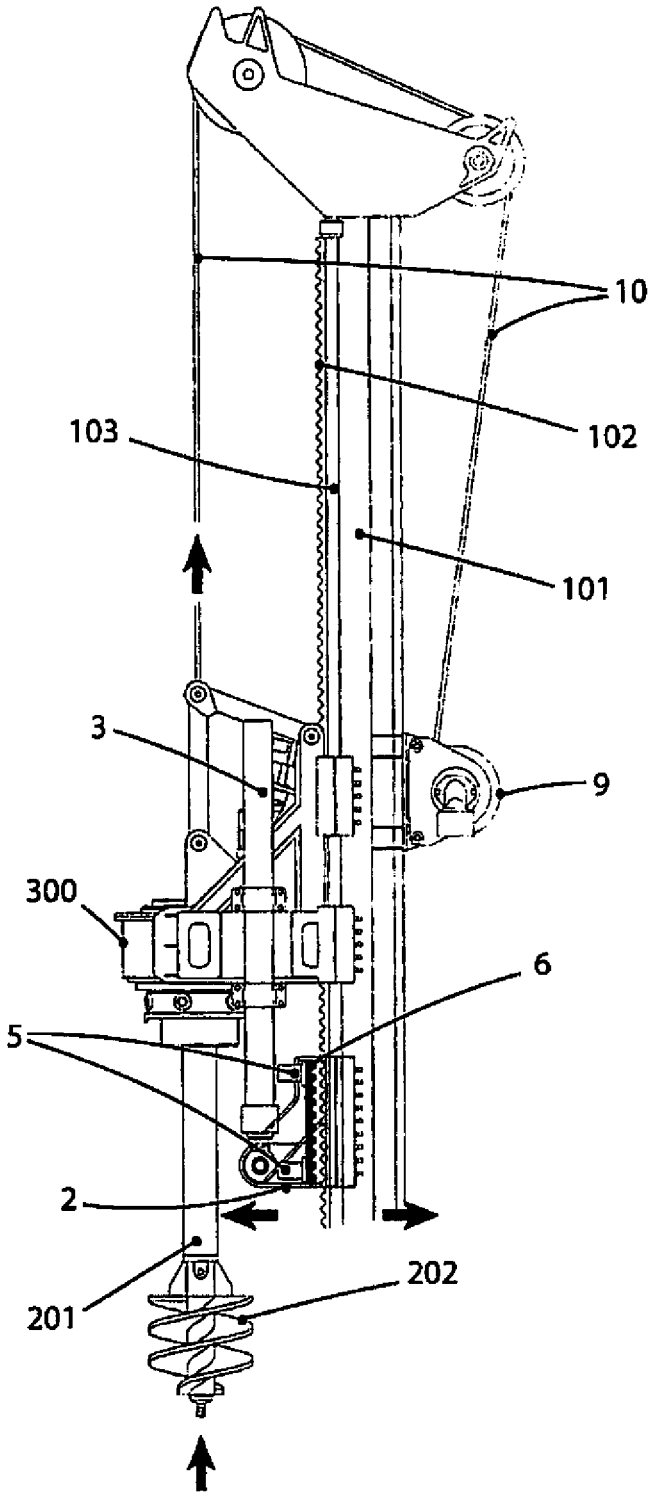
FIG. 7 shows a side view of the handling system as in FIG. 3, in a third embodiment of use.

As shown in FIG. 7, when digging equipment 200 must be extracted from the hole previously made in the ground, such an extraction is advantageously realised by means of handling system 1 in a third embodiment of use, in which:

first of all, blocking jacks 5 retract by releasing toothed element 6 from rack 102 of tower 101;

then, winch 9 exerts a tension of rope 10 such to retract from the hole already made digging equipment 200.

For such reason, in the third embodiment of use, digging equipment 200, power assembly 300 and element 2 are integrally stretched towards the top of tower 101 by means of rope 10.

By using the handling system in its second embodiment, no changes are made with respect to what previously described for the third embodiment of use.

During the extraction phase of digging equipment 200 from the hole, the blocking of this latter or even its braking can occur during its lifting, with such a resistance to block also the rotation of winch 9. In particular by using heavy batteries, necessary to reach great depths or to perform the drilling with a great diameter, it is advantageous to use the drilling phase, but in the extraction more powerful lifting devices are then necessary.

Figure 8:
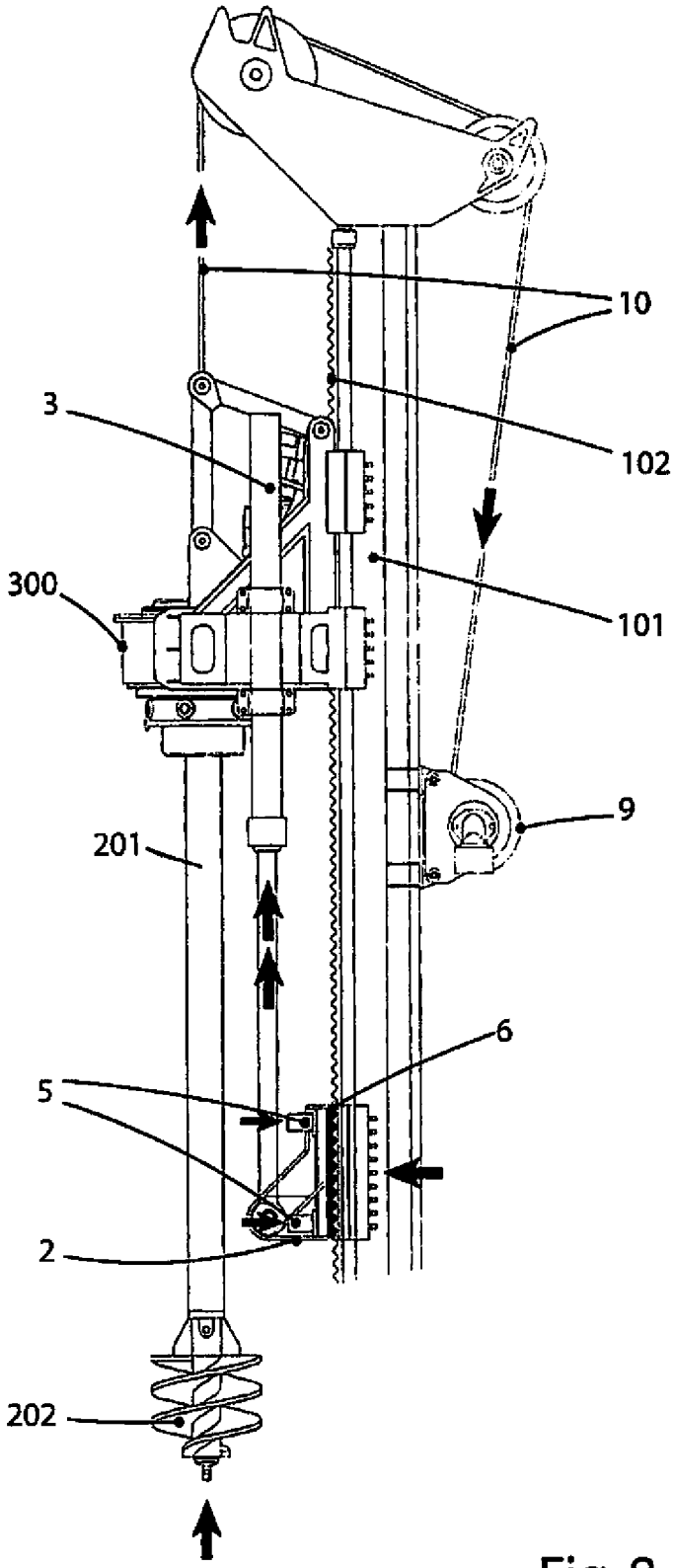
FIG. 8 shows a side view of the handling system as in FIG. 3, in a fourth embodiment of use.

In such a case, the handling system is configured in a fourth embodiment of use, represented in FIG. 8.

In such an embodiment of use, in order to assist the traction force applied by winch 9 tensioning rope 10 by integrally forcing digging equipment 200 with power assembly 300 to lift towards the top of tower 101, also cylinder 3 is used.

In this case first of all blocking jacks 5 extend by engaging again toothed element 6 against rack 102, so linking element 2 to tower 101 in a rigid way; so cylinder 3 extends by applying a resistance between element 2 and power assembly 300 pushing the same upwards, together with digging equipment 200, in a direction opposite to the ground and so it assists its exit from the hole.

Obviously, if the second embodiment of the handling system according to the present invention is used, cylinder 3 does not extend but it will retract, because element 2 is placed above power assembly 300 in such an embodiment.

Therefore, in the second embodiment the force applied by hydraulic cylinder 3 is not a distancing force between power assembly 300 and element 2, but a mutual approaching force.

The combined action of cylinder 3 and winch 9 permits to develop arising forces also approx. 100 tons.

It is known that the resistance against the extraction of digging equipment 200 from the hole, during a grounding in the soil is destined typically to rapidly fall, after the releasing of the equipment itself. For such a reason, typically after the releasing of digging equipment 200 by configuring the handling system in its fourth embodiment of use, it is possible to return to the normal rapid extraction of digging equipment 200 with the third embodiment of use previously described.

When the stroke of cylinder 3 is finished and element 2 is at a maximum distance from power assembly 300, one can proceed with the disengaging of toothed element 6 from rack 102, whereas winch 9 keeps blocked digging equipment 200 and the power assembly itself.

Now cylinder 3 is retracted and element 2, by means of the rise of its level, is again approached to power assembly 300.

In the second embodiment of the handling system according to the present invention, when the stroke of cylinder 3 is finished (in retraction), the element 2 is already at its minimum distance from power assembly 300 and at its maximum height with respect to the ground.

Figure 9:
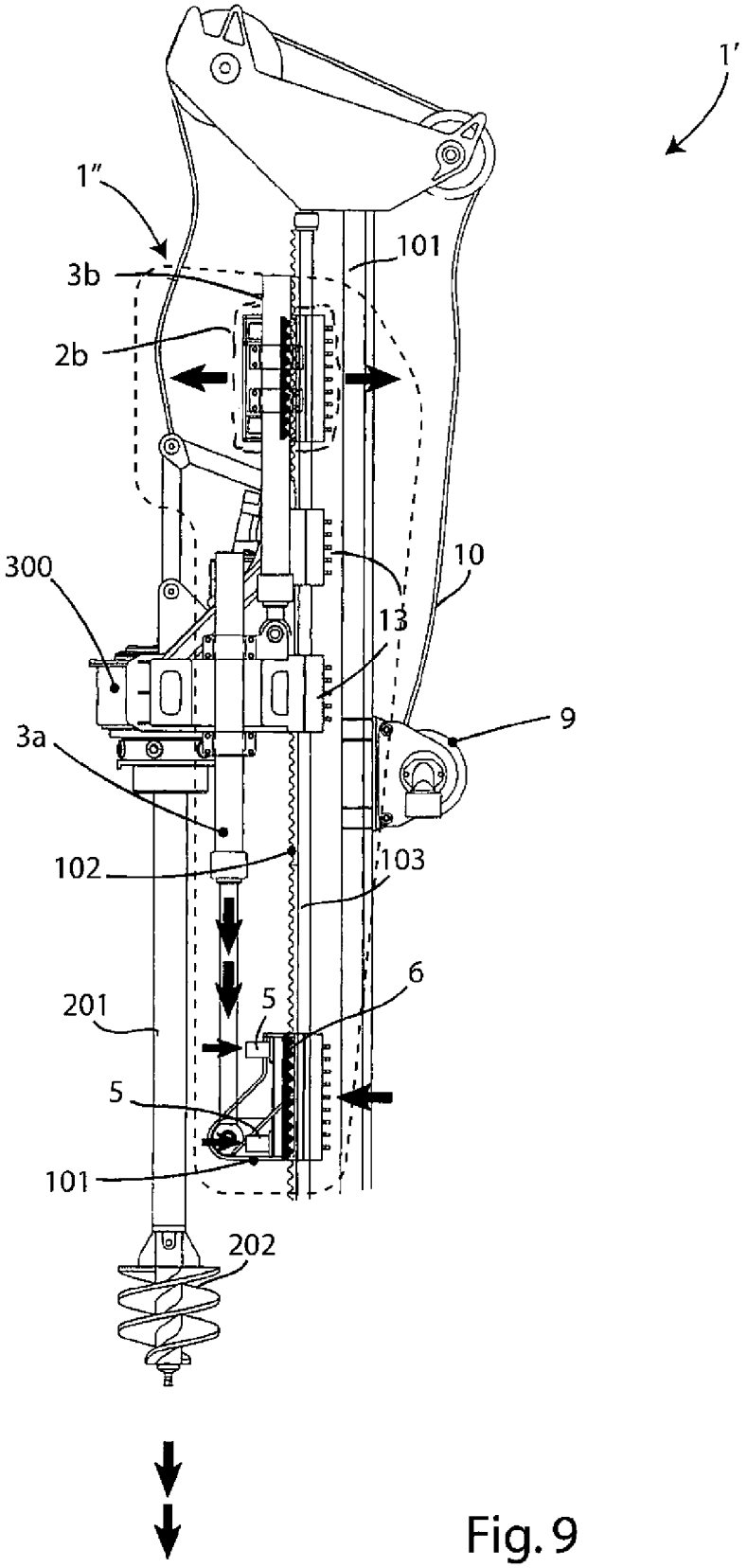
FIG. 9 shows a side view of a detail of the tower in FIG. 1, of the digging equipment in FIG. 1 and of a third embodiment of a handling system according to the present invention.

As shown in FIG. 9, a third embodiment of the handling system that is the object of the present invention differs from the previous ones in that it permits a solution with a continuous traction and the pushing of digging equipment 200 and power assembly 300. In particular, the third embodiment has two elements 2*a*, 2*b* respectively placed over and under power assembly 300; each of two elements 2*a*, 2*b* is linked to a first end of a respective cylinder 3*a*, 3*b* preferably of hydraulic type, whose second end is on the other hand linked to power assembly 300, which therefore, as the other embodiments, is rigidly connected also with digging equipment 200. It is obvious that the lifting or pushing force components can be transmitted to digging equipment 200 through known transmission systems permitting the use of mechanical returns, or friction systems, or even fixing systems (bolts, pins, keys, mechanical returns). Generally the digging equipment is then free to rotate (moved by the rotary parts of power assembly 300) and/or in other cases it can be partially freed in an axial direction, in order to permit the insertion by percussion, and in any case it is apt to transmit the known digging motions.

Each of the two elements 2*a*, 2*b* has a respective toothed element 6 which can be actuated by means of blocking jacks 5.

In the third embodiment of the handling system according to the present invention, when it is necessary to have strong traction/pushing values as previously described, it is possible to use one of the two elements 2*a*, 2*b*; as soon as first cylinder 3*a* connected to respective first element 2*a* in use reaches the end of the stroke, it is possible to engage rack 102 with other element 2*b*, by releasing from this latter element 2*a* previously used and beginning to use opposite element 2*b*.

If necessary, the two elements 2*a*, 2*b* can be blocked together, and the respective cylinders 3*a*, 3*b* are also actuated together for maximizing the values of the pushing and extraction forces.

Substantially, the third embodiment combines in this way the operation of the first and the second embodiment previously described, with a further advantage given from the continuity of the traction the absence of discontinuity in the handling speed or by reaching greater forces with the same power of the single cylinder (or of a pair of cylinders) 3 in the two previous embodiments.

Furthermore, as shown in FIG. 9, winch 9 in this configuration could be not useful, as the guarantee of suspension of power unit 300 dragging cylinders 3*a* and/or 3*b*, is exerted by any of elements 2*a* or 2*b*.

The actuation operations of this realization force can be automated by using sequential hydraulic valves and/or positioning sensors for reducing to a minimum the intervention of the operator and permitting the maximum speed and continuity of the movement.

Figure 10:
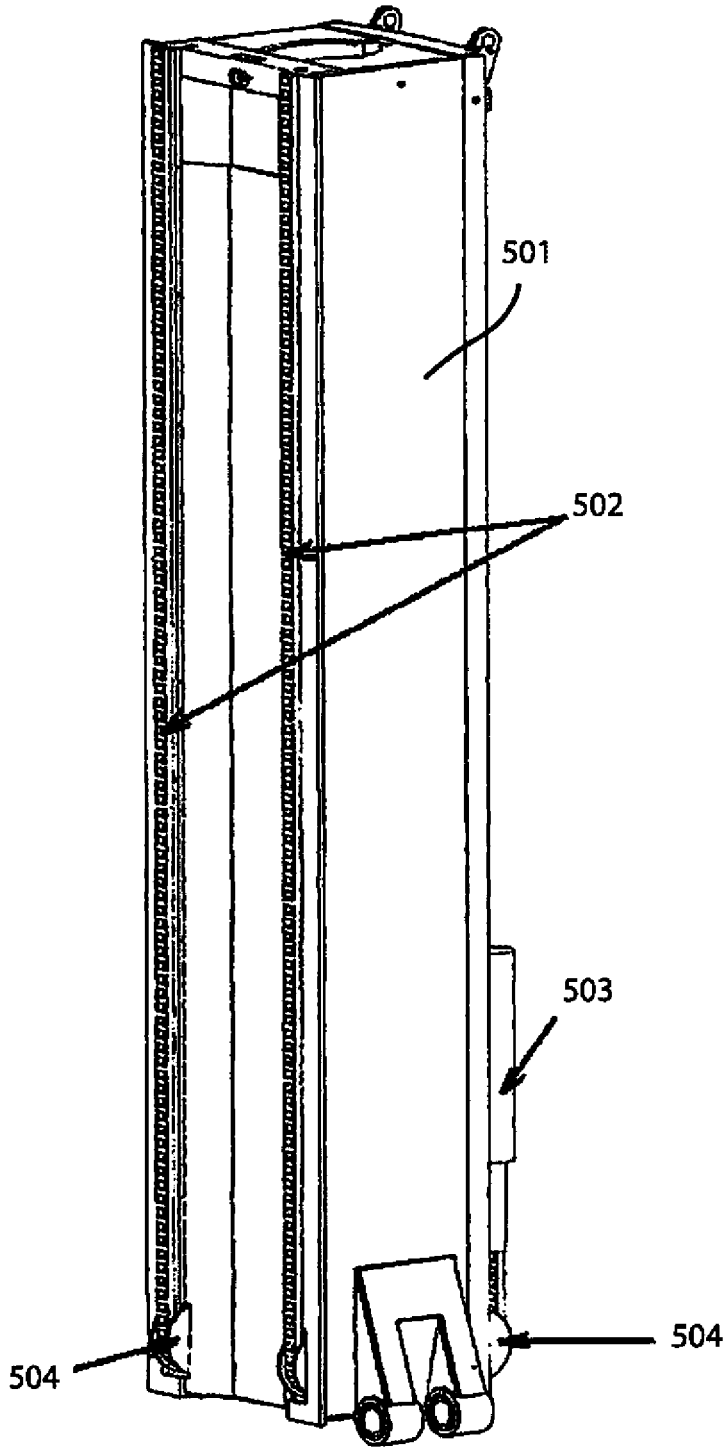
FIGS. 10 and 11 show respectively a first and a second variant of the tower shown in FIG. 2.

Although tower 101 has been already described until now as a tower provided with a pair of tracks 102, other types of towers can be apt for the installation of handling system 1 that is the object of the present invention; FIG. 10 shows a tower 501 in which the tracks are substituted by a pair of chains 502 placed along a direction parallel to the direction of maximum extension of tower 501 itself; such chains are wrapped at least around a sprocket wheel 504 inserted near the lower portion of tower 501 and are tensioned by means of a mechanical or hydraulic tensioner 503. This solution permits in an easier way the application of the handling system without requiring adaptations and pre-settings on whole tower 501.

Obviously the just described system works in an equal manner even if the branches of the chains are fixed directly to the opposite ends of tower 501 without sprocket wheels 504, or if sprocket wheels 504 with their tensioning devices are placed only on the top, or finally if they are inserted on both the ends with double tensioning devices. The tensioning devices can also work not in axis with the chain, but they can be for example of the pulley type, where the tensioner works with movements orthogonal to the direction of maximum extension of the chain itself. Finally, the chain could also be single and preferably centrally placed.

Figure 11:
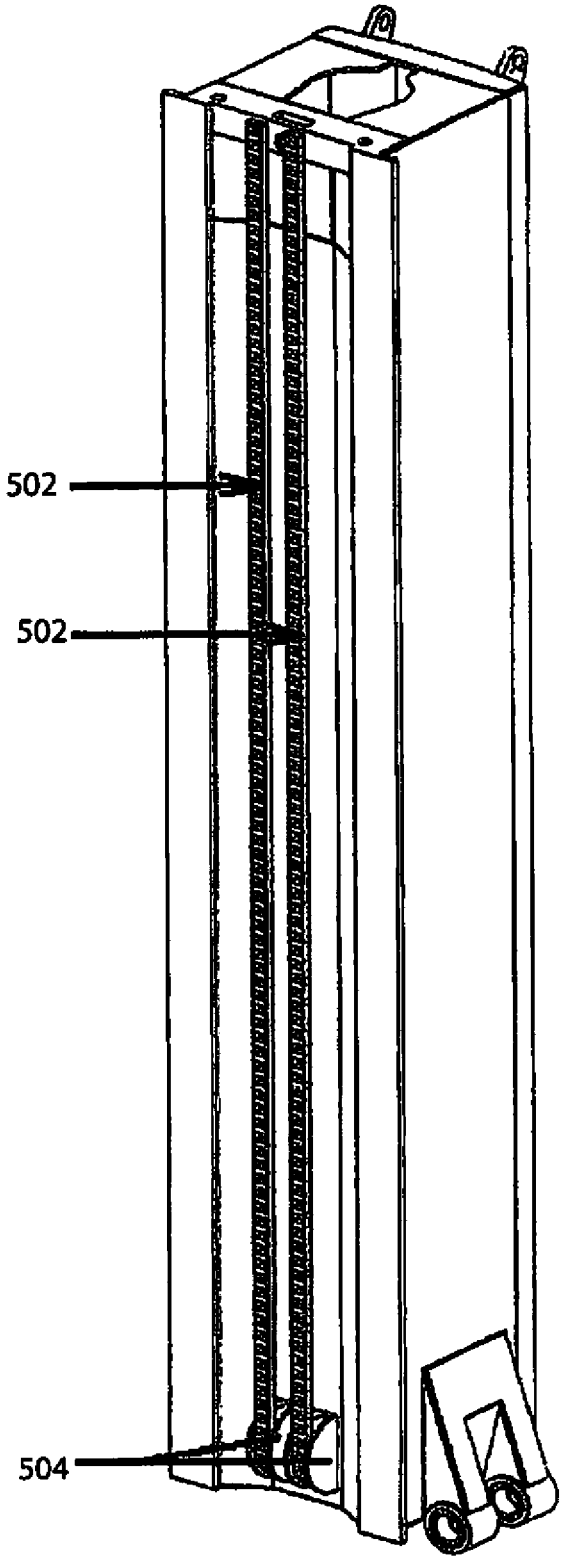

Still as an alternative, as shown in FIG. 11, chains 502, even in a number greater than two, can be mounted in an approached position and substantially in proximity of the centerline of a side wall of tower 501 itself.

The fixing and tensioning system is the same as that of FIG. 10. The number of chains can vary from just one to an indefinite number: in such a case the chains are mounted side by side.

A further embodiment of element 2 can be obtained, by means of a rotary device, of the sprocket wheel or toothed wheel type, which is free to idly rotate around its own axis, being dragged by the rise and descent movements of digging device 300. The rotation of rotary device is caused by the contact of mechanical returns on suitable return seats, which can be the same as those of a previously described track, or the spaces of a chain 502. When it is necessary to apply an additional force with the cylinders, rotary device can be blocked in rotation, through the actuation of not represented known systems (axially pushed conical elements, friction systems, frontal or radial joints, etc.) and so the mechanical return is able to transmit the reaction forces to tower 101. Even if it is not represented in the figures, return slide 4 can be used in order to avoid that coupling elements, 102 can recede and separate themselves. Having to transmit relevant forces the seat with the spaces can be realized also by using sheet plates of great thickness suitably drilled and shaped.

The advantages of the handling system which is the object of the present invention are known in the light of the previous description. In particular, it permits to obtain an operation combining the advantage of the handling systems of the flexible type in relation with the rigid ones (or with high handling speeds of digging equipment 200, up to 80 m/min, without having to increase the flow rate of the system and consequently sparing some power in the application) with the advantages which the traditional rigid handling systems (either linear actuator or hydraulic cylinder) have with respect to the flexible ones (namely the development of very high forces, required in this applications up to or over 100 tons, and with very high efficiencies).

Such an advantage is realized with the combined action of a tension by a winch 9 with a rope 10 without the help of reduction return of the speed of rope 10; therefore complicated mechanical construction are not necessary on the head of the tower, adapted to generate multiplied tractions.

Obviously a simplification of the lifting system, producing a reduction of the kinds of tractions (for example from 4 to 2, from 6 to 3 or up to 4 traction lines) represents in any case an advantage in relative terms and the invention finds an advantageous application even in this cases.

The absence of reduction returns on the head of tower 101 also permits a reduction of the weight over the center of gravity of the assembly, with a consequent improvement of the stability and with a greater design freedom of the various components.

Therefore, with the same rotary speed of the drum of winch 9, the present invention permits a greater extraction speed of digging equipment 200 from the drilled hole, in comparison with a flexible traditional handling system provided with reduction returns. Rope 10 with a direct traction permits a rapid extraction phase of digging equipment 200 from the previously drilled hole, which is anyhow limited by de-multiplying returns.

The presence of at least one cylinder 300 can greatly increase the extraction force of digging equipment 200 from the hole, in comparison with a traditional flexible handling system also provided with returns.

Furthermore, the handling means according to the present invention permit a combined action of traction towards the top of tower 101 and pusher towards the ground, without the constraint of limited or reduced lifting speed of digging equipment 200.

Furthermore, the handling system of the present invention permits to hook the cylinder in any position along the antenna and so to exert the high pushing or extraction forces in any condition of digging. This aspect can be particularly advantageous when drilling rods are added and so the position of the power unit can vary along the entire stroke of the antenna.

Furthermore, the third embodiment of the present invention is particularly useful when applied to digging technologies where it is important to avoid the stopping times of power assembly 300. For example, the main advantages are obtained during the mechanical mixing, which provides for the injection in the ground of cement mortars in which, for obtaining a good result of the treatment, it is necessary to guarantee a constant ascent velocity also without interruptions.

Finally it is important to pay attention to the fact, that all the previously describe functioning operations, other than being realized be manual remote controls, can be realized through an electronic system for the management of the digging, comprising electro-valves for the handling of cylinders 3 and blocking jacks 5, of servomechanisms for the actuation of winch 9 and in some cases for pressure sensors adapted to detect the blocking of the digging equipment 200 in the ground and by depth gauges for detecting the actual level of the digging head and of cylinder means 3, either one relative to the other absolute with respect to the ground or to the ends of tower 101.

To the so far described device some variations, additions and modifications can be applied, obvious for an expert in the field, without departing from the protection field given in the annexed claims.

For example, the number of pulleys on where the rope slides can vary with respect to the pair previously described and illustrated in the annexed Figures; furthermore, the number of hydraulic cylinders can be multiplied, in the case the producer of the system of the present invention deems it convenient to place side by side, also for scopes of redundancy, a plurality of hydraulic cylinders of lesser performances at the place of a single cylinder with greater performances.

For safety reasons also, a security system can also be implemented, functioning in case of breaking on rope 10 of winch 9, in order to immediately open blocking jacks 5 to avoid the fall of power assembly 300 and of digging equipment 200 on the ground.

Finally the same winch 9 or a dedicated further one could be connected from the opposite side to digging equipments 200 and so to digging head 300, with respect to what indicated in FIG. 3, with reference to the connection of traction means 10 in order to actuate a pushing operation. Also in this case, the invention can be applied and maintained unchanged its features and relative advantages.

The invention claimed is:

1. Handling system of drilling equipment of the ground, in which said drilling equipment slides along a support tower; the handling system comprising at least one linear actuator for handling said drilling equipment; said linear actuator being temporarily movable and releasable with respect to said support tower;

said linear actuator being temporarily blockable in any position along the support tower to impart forces to the drilling equipment in any operating condition;

elements connected at one end with the power assembly through said linear actuator and connectable in a temporarily bound way to said support tower;

said elements comprising at least one toothed element configured to mesh with a rack or chain integral with said support tower;

said elements further comprising at least one second linear actuator for handling said toothed element between said first and second positions;

wherein the toothed element is normally pushed by elastic elements in order to mesh on said rack or chain integral with said support tower and the at least one second linear actuator acting in contrast with said elastic elements to guarantee a safety block of the elements.

2. Handling system of drilling equipment of the ground, in which said drilling equipment slides along a support tower; the handling system comprising at least one linear actuator for handling said drilling equipment; said linear actuator being temporarily movable and releasable with respect to said support tower;

further comprising elements connected at one end with the power assembly through the linear actuators and connectable in a temporarily bound way to said support tower;

said elements comprise at least one toothed element configured to mesh with a rack or chain integral with said support tower;

said at least one toothed element moves between a first non-meshing position with said rack or chain and a second meshing position with said rack or chain.

3. Handling system according to claim 2, wherein the handling system comprises at least one rope, the at least one roping exerting at least one extraction force of said drilling equipment from said ground, and at least one linear actuator exerting an extraction force and a pushing force of said drilling equipment respectively from/towards said ground.

4. Handling system according to claim 3, further comprising a winch for the traction of said at least one rope.

5. Handling system according to claim 3, wherein the at least one rope is upper disposed with respect to the drilling equipment, for traction and lower disposed with respect to the drilling equipment for pushing of the drilling equipment from/towards said ground.

6. Handling system according to claim 2, wherein said linear actuator comprises at least one hydraulic cylinder.

7. Handling system according to claim 6, wherein in a first operational position, said at least one hydraulic cylinder exerts a traction/pushing force from/towards said ground and in which said toothed element meshes on said rack or chain.

8. Handling system according to claim 6, wherein in a second operational position at least one rope and said at least one hydraulic cylinder exert together an extraction force of said drilling equipment from said ground.

9. Handling system according to claim 6, wherein said at least one hydraulic cylinder and said linear actuator are controlled through electro-valves controlled by an electronic management system of the drilling operation, to automate the operation of the system.

10. Handling system according to claim 6, wherein actuation of controls is manual and remote.

11. Handling system according to claim 2, further comprising at least one second linear actuator for handling said toothed element between said first and second positions.

12. Handling system according to claim 11, wherein at least one of said linear actuators is an actuating cylinder.

13. Handling system according to claim 11, wherein the toothed element is normally pushed by elastic elements in order to mesh on said rack or chain integral with said support tower and the at least one linear actuator acting in contrast with said elastic elements to guarantee a safety block of the elements.

14. Handling system according to claim 2, wherein the elements are independent.

15. Handling system according to claim 2, wherein the linear actuators are at least in a number of two and act on respective and distinct connection means selectively connectable in a temporarily bound way to said support tower.

* * * * *